US006503102B1

(12) United States Patent
Zhang et al.

(10) Patent No.: US 6,503,102 B1
(45) Date of Patent: Jan. 7, 2003

(54) ELECTRICAL CONNECTOR ASSEMBLY

(75) Inventors: Guo Zeng Zhang, Kunsan (CN); GuangXing Shi, Kunsan (CN); ZhiQiang Wang, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/027,590

(22) Filed: Dec. 19, 2001

(51) Int. Cl.[7] ..... H01R 13/648
(52) U.S. Cl. ..... 439/607
(58) Field of Search ..... 439/607, 609, 439/701, 540.1

(56) References Cited

U.S. PATENT DOCUMENTS 6,224,422 B1 * 5/2001 Zhu et al. ..... 439/607
6,383,024 B1 * 5/2002 Wang et al. ..... 439/607
6,419,529 B1 * 7/2002 Shi et al. ..... 439/701

* cited by examiner

*Primary Examiner*—Tho D. Ta
*Assistant Examiner*—Ann McCamey
(74) *Attorney, Agent, or Firm*—Wei Te Chung

(57) ABSTRACT

A USB connector assembly (1) comprises an insulating housing (10) including a T-shaped main section (11) and a pair of mating tongues (12) extending from opposite ends of the T-shaped main section, a plurality of terminals (30) received in the insulating housing, a pair of front shells (20) receiving the mating tongues, a rear shell (40) enclosing a rear portion (19) of the T-shaped main section, and a screw (50) engaging with a screw hole (140) defined in the insulating housing through through-holes (220) of the pair of front shells for securing the front shells on the insulating housing.

4 Claims, 7 Drawing Sheets

ELECTRICAL CONNECTOR ASSEMBLY

BACKGROUND OF THE INVENTION

1. Field of the Invention

The present invention relates to an electrical connector assembly, and particularly to a Universal Serial Bus (USB) connector assembly comprising a pair of USB connectors arranged side by side.

2. Description of Prior Art

USB connectors are widely employed in high speed data transmissions. A conventional USB connector assembly having a pair of USB connectors arranged side by side is disclosed in U.S. Pat. No. 6,224,422. Rear portions of insulating housings of the pair of USB connectors are interconnected by a pair of cross members. Each USB connector has a rear shell enclosing the rear portion thereof. However, the two cross members connected between the pair of USB connectors may break under vibration test.

Hence, a USB connector assembly having increased strength is desired.

BRIEF SUMMARY OF THE INVENTION

The object of the present invention is to provide a USB connector assembly having an integrally formed insulating housing and a one-piece rear shell for increasing the strength thereof to avoid breaking.

A USB connector assembly in accordance with the present invention includes an insulating housing, a plurality of terminals received in the insulating housing, a pair of front shells, a unitary rear shell and a screw for securing the front shells on the insulating housing. The insulating housing includes a T-shaped main section and a pair of mating tongues extending from opposite ends of the T-shaped main section. The T-shaped main section comprises a rear portion and a retaining portion extending vertically from the middle of the rear portion. A pair of receiving slots are defined in the rear portion on opposite sides of the retaining portion. Each front shell defines a receiving space for retaining a corresponding mating tongue therein. The rear portion of the insulating housing is enclosed by the rear shell. The rear shell has a pair of forwardly extending doors inserted into corresponding receiving slots. Each front shell has a retaining plate extending from a lateral rear edge thereof. The retaining plate is received in the corresponding receiving slot. The rear shell also defines a pair of notches beside the pair of doors. The retaining plates of the front shells form a pair of retaining tails which are vertically bent and cooperate with the notches of the rear shell. Each front shell also comprises an engaging plate opposite to the retaining plate. The engaging plate defines a plurality of cutouts and an opening for correspondingly receiving a plurality of projections formed on the rear portion of the insulating housing and a protrusion stamped from the rear shell for securing the front shell with the insulating housing and the rear shell.

Other objects, advantages and novel features of the invention will become more apparent from the following detailed description of the present embodiment when taken in conjunction with the accompanying drawings.

DETAILED DESCRIPTION OF THE INVENTION

Figure 1:
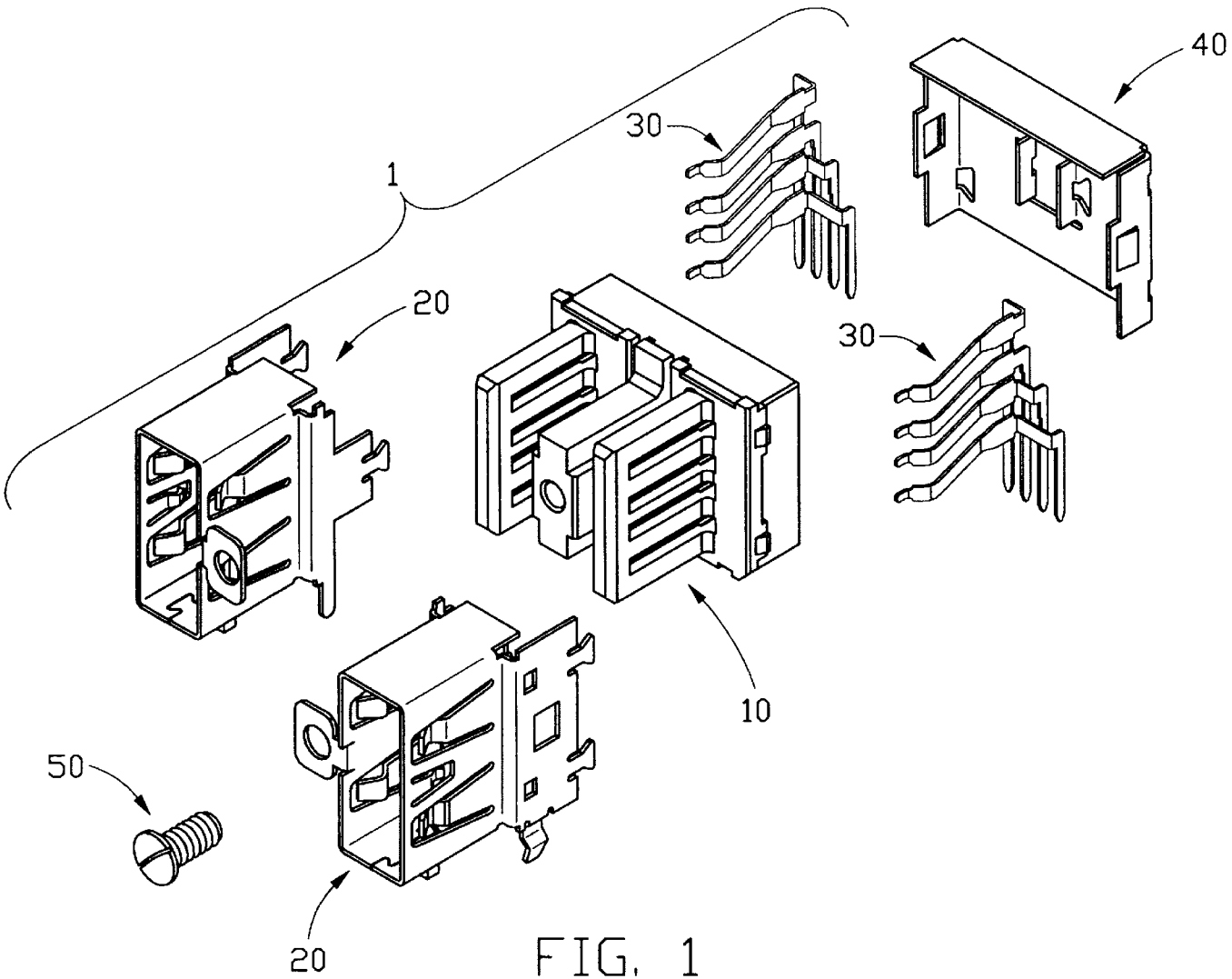
FIG. 1 is an exploded perspective view of a USB connector assembly in accordance with the present invention.
Figure 2:
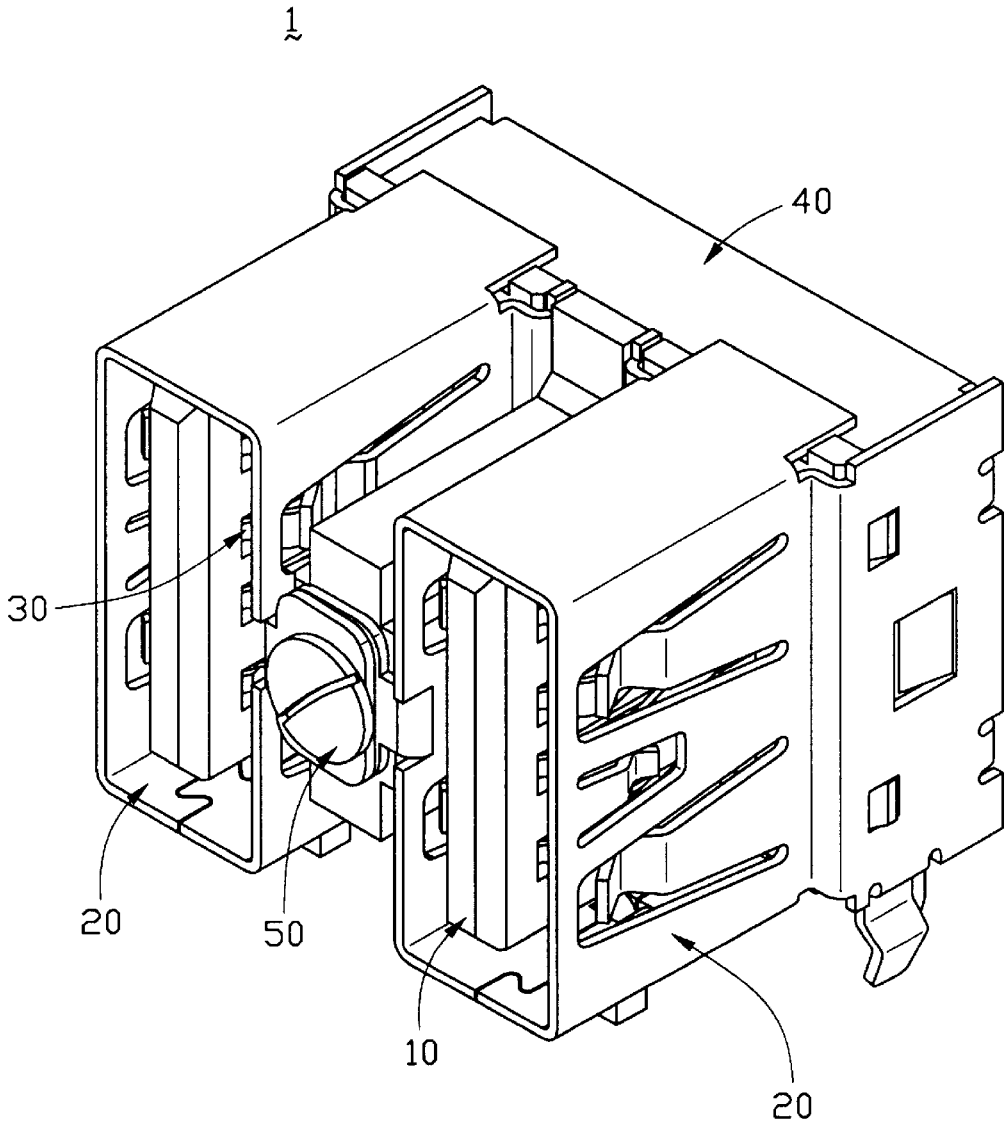
FIG. 2 is an assembled perspective view of the USB connector assembly shown in FIG. 1.

Referring to FIGS. 1 and 2, a USB connector assembly 1 in accordance with the present invention comprises an insulating housing 10, a plurality of terminals 30 received in the insulating housing 10, a pair of front shells 20 fitted to a front portion of the insulating housing 10, a rear shell 40 enclosing a rear portion of the insulating housing 10, and a screw 50 securing the pair of front shells 20 on the insulating housing 10.

Figure 3:
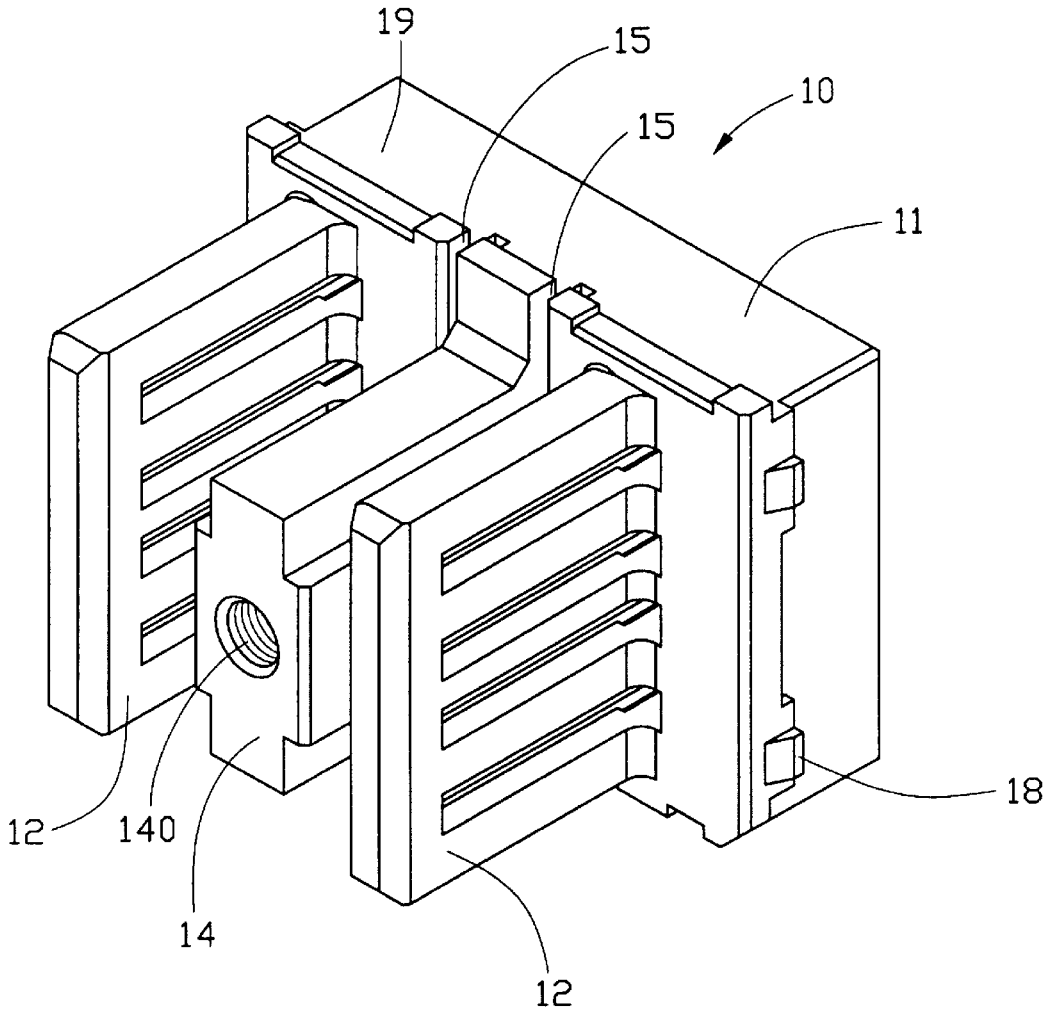
FIG. 3 is a perspective view of an insulating housing of the USB connector assembly shown in FIG. 1.

Referring to FIG. 3, the insulating housing 10 comprises a T-shaped main section 11 including a rear portion 19 and a retaining portion 14 extending vertically from the middle of the rear portion 19, and a pair of mating tongues 12 projecting forwardly from opposite ends of the rear portion 19 and separated by the retaining portion 14. A screw hole 140 is defined in the retaining portion 14 to engage with the screw 50. A pair of receiving slots 15 (FIG. 7) are defined through the rear portion 19 on opposite sides of the retaining portion 14. A plurality of projections 18 are respectively formed on opposite lateral sides of the rear portion 19 adjacent to front edges thereof.

Figure 4:
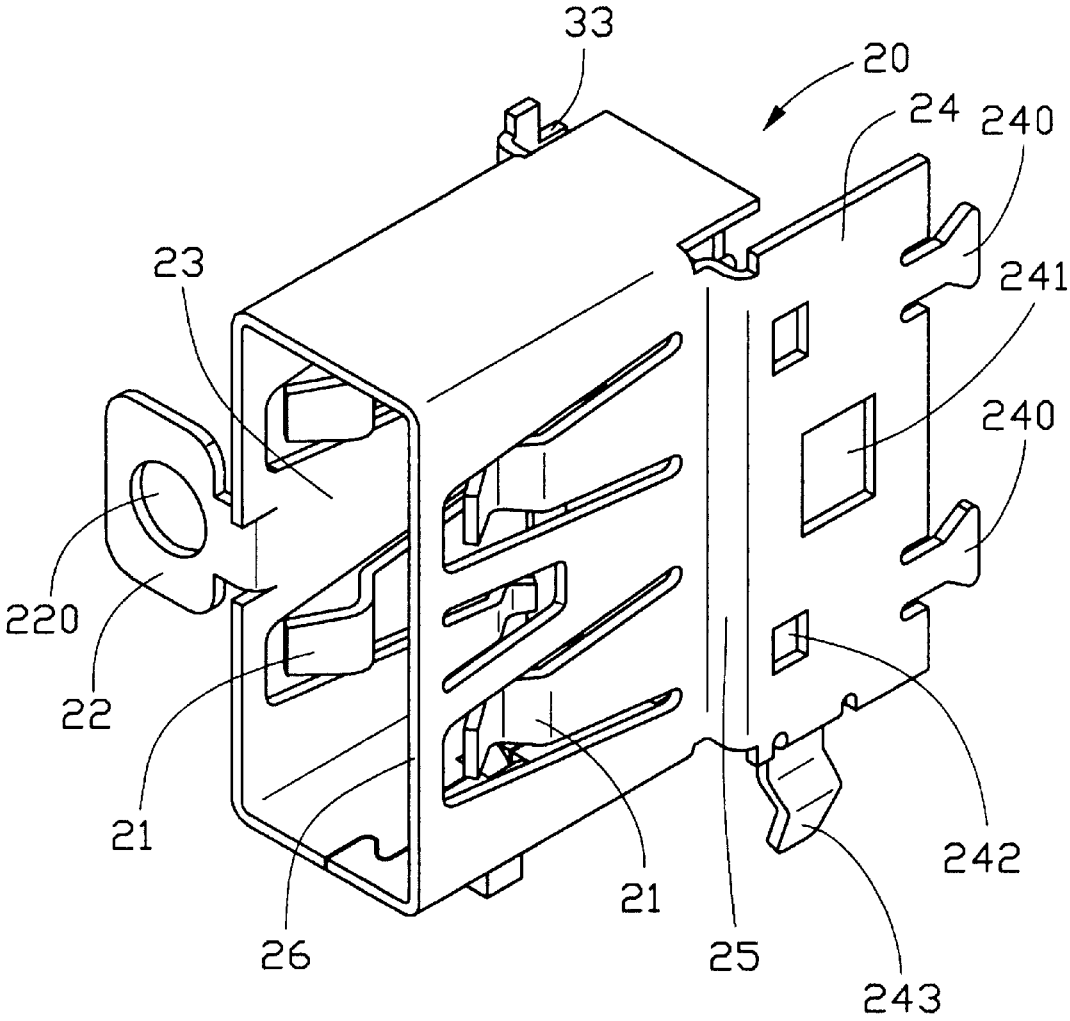
FIG. 4 is a perspective view of one front shell of the USB connector assembly shown in FIG. 1.
Figure 5:
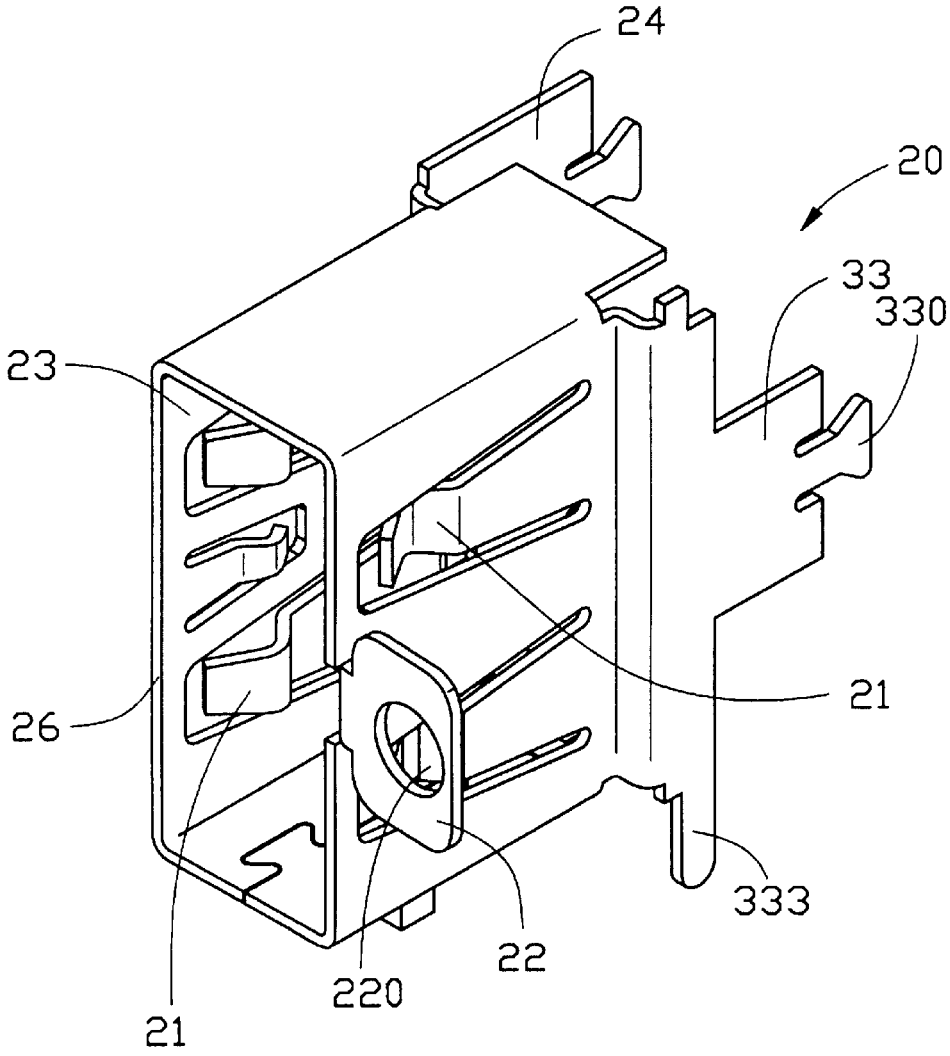
FIG. 5 is a perspective view of the other front shell of the USB connector assembly shown in FIG. 1.

Referring to FIGS. 4 and 5, the two front shells 20 for respectively enclosing corresponding mating tongues 12 of the insulating housing 10 are designed symmetrically and each defines a receiving space 23 surrounded by integrally formed walls (not labeled) and a rectangular mating opening 26 at the front thereof in communication with the receiving space 23 for receiving a corresponding mating connector (not shown). A plurality of resilient tabs 21 extend into the receiving space 23 for retaining the corresponding mating connector therein. A retaining pad 22 with a through hole 220 defined therein projects from an inner lateral front edge of the front shell 20 and extends vertically towards the retaining portion 14 of the T-shaped main section 11 for aligning with the screw hole 140. Each front shell 20 comprises an engaging plate 24 extending rearwardly from one lateral rear edge 25 thereof. The engaging plate 24 defines a pair of rectangular cutouts 242 for engaging with corresponding projections 18 of the rear portion 19. A rectangular opening 241 is defined between the two rectangular cutouts 242 and a pair of retaining feet 240 extend beyond a rear edge of the engaging plate 24. The engaging plate 24 further has a board lock 243 extending downwardly from a bottom edge thereof for being inserted into a corresponding hole of a printed circuit board (not shown).

Particularly referring to FIG. 5, each front shell 20 has a retaining plate 33 extending rearwardly from the other lateral rear edge thereof opposite to the engaging plate 24 for being received in a corresponding receiving slot 15 of the T-shaped main section 11. The retaining plate 33 has a rearwardly extending retaining tail 330 and a downwardly extending straight leg 333 for being inserted into a corresponding hole of the printed circuit board.

Figure 6:
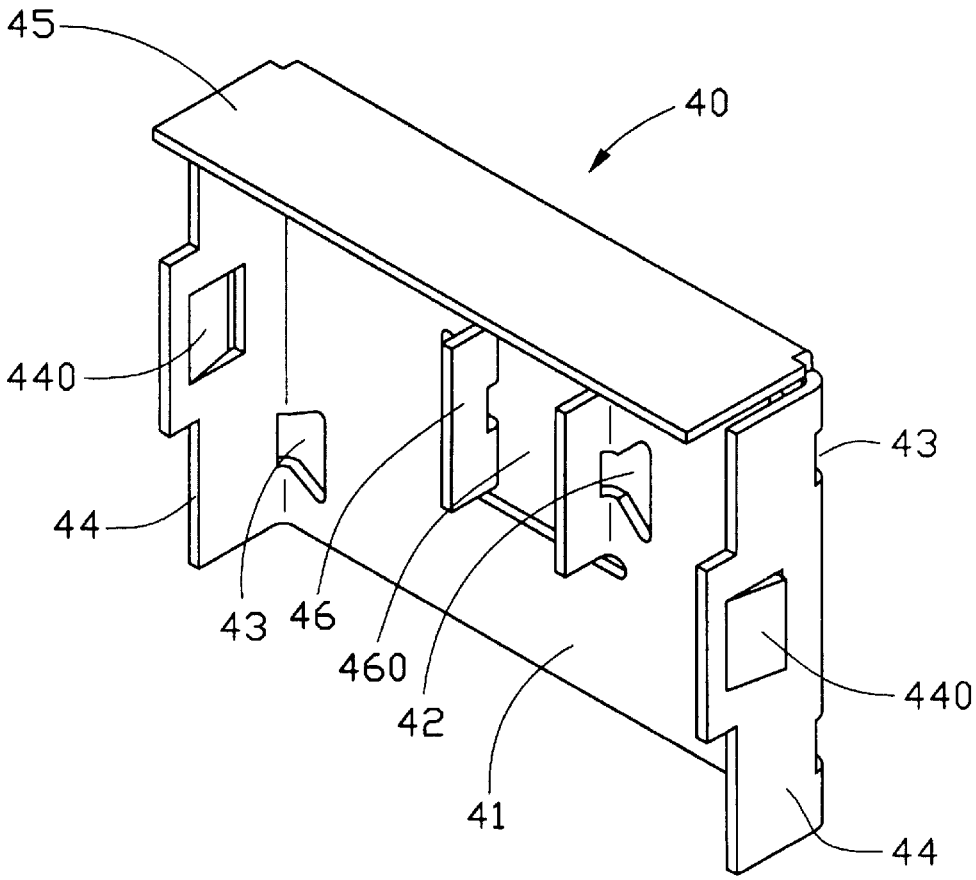
FIG. 6 is a perspective view of a rear shell of the USB connector assembly shown in FIG. 1.

Referring to FIG. 6, the rear shell 40 of the present invention is integrally formed and substantially encloses the whole rear portion 19 of the insulating housing 10. The rear shell 40 comprises a top plate 45 for covering a topside of the rear portion 19 and a pair of lateral plates 44 for overlapping opposite sides of the rear portion 19. Each lateral plate 44 has a protrusion 440 stamped therefrom for being received in the rectangular opening 241 of the engaging plate 24 of the corresponding front shell 20. Two pairs of notches 43 are respectively defined in opposite rear side edges of the rear shell 40 for receiving corresponding retaining feet 240 of the front shells 20. The rear shell 40 further comprises a pair of inwardly extending opposite doors 46, between which a window 460 is defined. Two notches 42 are further defined beside corresponding doors 46 of the rear shell 40 in communication with the window 460 for receiving the retaining tails 330 of the front shells 20.

Figure 7:
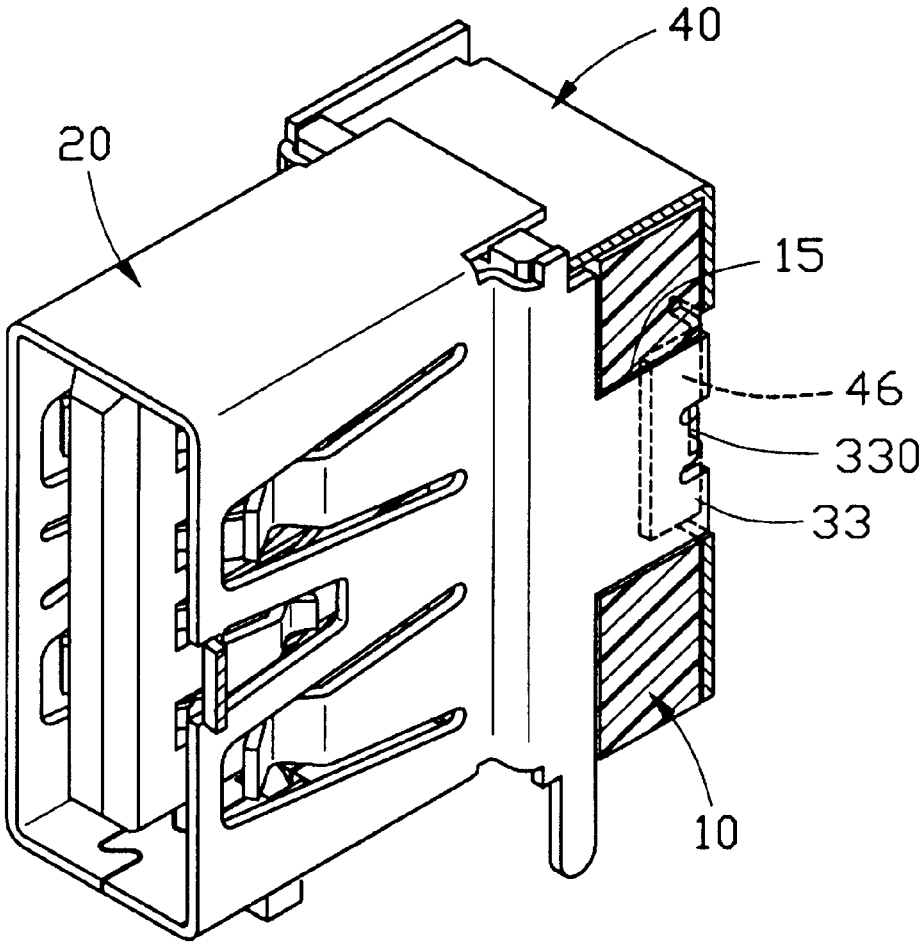
FIG. 7 is a cut-away cross-sectional view of the USB connector assembly shown in FIG. 2.

In assembly, referring to FIGS. 1, 2 and 7 altogether, the plurality of terminals 30 are inserted into the insulating housing 10 from the rear. The rear shell 40 is then assembled to the rear portion 19 of the insulating housing 10 from a rear side, whereby the pair of doors 46 are inserted into the receiving slots 15 of the insulating housing 10 and the lateral plates 44 overlap opposite sides of the rear portion 19. The two mating tongues 12 are respectively received in the receiving spaces 23 of the front shells 20, the retaining pads 22 of which overlap each other with the through-holes 220 aligning with the screw hole 140 of the retaining portion 14 of the insulating housing 10. Simultaneously, the engaging plates 24 of the front shells 20 covers the lateral plates 44 of the rear shell 40, whereby the projections 18 of the rear portion 19 of the insulating housing 10 are respectively received in the rectangular cutouts 242 of the front shells 20, the protrusions 440 of the rear shell 40 engage with the rectangular openings 241, and the retaining feet 240 of the front shells 20 are vertically bent and engage with the corresponding notches 43. The retaining plates 33 of the front shells 20 are respectively inserted into the receiving slots 15 of the insulating housing 10 and overlap corresponding doors 46 of the rear shell 40. The retaining tails 330 are then vertically bent and received in the notches 42 of the rear shell 40. Therefore, the front shells 20 and the rear shell 40 are firmly fastened. Finally, the screw 50 is inserted through the through-holes 220 of the retaining pads 22 and engages with the screw hole 140, thereby fixedly attaching the front shells 20 to the insulating housing 10.

Compared with the prior art, the integrally formed rear shell 40 reinforces a retaining force required for fastening the front shells 20 and the rear shell 40 together, and increases the strength of the whole housing 10 to avoid cracking. The configuration of the insulating housing 10 also increases the strength thereof.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

an insulating housing comprising a main section and a pair of mating tongues extending forwardly from said main section, said main section comprising a rear portion and a retaining portion extending forwardly from said rear portion between said mating tongues, said rear portion defining a pair of receiving slots therethrough on opposite sides of said retaining portion;

a plurality of terminals received in said insulating housing;

a rear shell enclosing said rear portion of said insulating housing, said rear shell having a pair of forwardly extending doors inserted into corresponding receiving slots, and a pair of notches beside said pair of doors; and a pair of front shells each retained to the rear shell and enclosing a corresponding mating tongue of the insulating housing, each front shell including a retaining plate received in a corresponding receiving slot and overlapping a corresponding door of said rear shell, and having a vertically bent retaining tail engaging with a corresponding notch of said rear shell;

wherein each front shell has an engaging plate opposite to said retaining plate;

wherein said engaging plate of each front shell defines a rectangular opening therein, and said rear shell comprises a pair of protrusions received in corresponding rectangular openings of said front shells;

wherein said engaging plate of each front shell defines a pair of rectangular cutouts beside said rectangular opening, and said rear portion of said insulating housing comprises a pair of projections formed on each of opposite sides thereof for being received in corresponding rectangular cutouts.

2. The electrical connector assembly as described in claim 1, wherein said retaining portion of said insulating housing defines a screw hole therein, and said front shells each has a through-hole in alignment with said screw hole for extension of a screw.

3. The electrical connector assembly as described in claim 1, wherein each front shell comprises a plurality of resilient tabs formed on opposite sides thereof and extending into said receiving space.

4. The electrical connector assembly as described in claim 1, wherein each front shell defines a rectangular mating opening at a front thereof in communication with said receiving space.

* * * * *